US011549325B2

(12) United States Patent
Maher et al.

(10) Patent No.: US 11,549,325 B2
(45) **Date of Patent: *Jan. 10, 2023**

(54) SYSTEMS AND METHODS FOR TETHERING SUBSEA BLOW-OUT-PREVENTERS

(71) Applicant: Trendsetter Vulcan Offshore, Inc., Houston, TX (US)

(72) Inventors: James V. Maher, Houston, TX (US); Ricky Brown, Houston, TX (US); Daniel McCelvey, Houston, TX (US); Donald La Vigne, Houston, TX (US)

(73) Assignee: Trendsetter Vulcan Offshore, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 17/482,184

(22) Filed: Sep. 22, 2021

(65) Prior Publication Data

US 2022/0010645 A1 Jan. 13, 2022

Related U.S. Application Data

(63) Continuation of application No. 17/432,828, filed as application No. PCT/US2020/018874 on Feb. 19, 2020.

(60) Provisional application No. 62/808,486, filed on Feb. 21, 2019.

(51) Int. Cl.
*E21B 33/038* (2006.01)
*E21B 33/035* (2006.01)

(52) U.S. Cl.
CPC ..... *E21B 33/038* (2013.01); *E21B 33/0387* (2020.05)

(58) Field of Classification Search
CPC ..... B63B 21/04; B63B 21/50; E21B 33/038; E21B 33/0387; E21B 33/064; E21B 41/0007
See application file for complete search history.

(56) References Cited

U.S. PATENT DOCUMENTS

| | | | | |
|---|---|---|---|---|
| 9,074,447 | B1 | 7/2015 | Cox | |
| 9,284,806 | B2 | 3/2016 | Gutierrez et al. | |
| 9,359,852 | B2 | 6/2016 | Kebadze et al. | |
| 2005/0241558 | A1* | 11/2005 | Barlow | B63B 21/50 114/200 |
| 2006/0042800 | A1* | 3/2006 | Millheim | E21B 33/035 166/344 |
| 2010/0242822 | A1* | 9/2010 | Cole | E02B 3/20 114/230.2 |
| 2014/0374115 | A1* | 12/2014 | Kebadze | E21B 41/0007 166/345 |

(Continued)

FOREIGN PATENT DOCUMENTS

WO WO-2019068130 A1 * 4/2019 ..... B63B 21/50

*Primary Examiner* — James G Sayre
(74) *Attorney, Agent, or Firm* — Jonathan Pierce; Pierre Campanac; Porter Hedges LLP

(57) ABSTRACT

A tensioning system includes a combined rope gripper and tension cylinder. A rope passes through the combined rope gripper and tension cylinder. Once the length and/or tension of the rope has been adjusted, a reel lock handle can be actuated to prevent further rotation of the reel. The combined rope gripper and tension cylinder can be actuated to hold the rope. The combined rope gripper and tension cylinder can also be actuated to reduce or prevent the release of tension in the rope.

12 Claims, 8 Drawing Sheets

(56) References Cited

U.S. PATENT DOCUMENTS

| | | | | |
|---|---|---|---|---|
| 2014/0374116 | A1 | 12/2014 | Kelso et al. | |
| 2020/0030025 | A1 | 1/2020 | Maher | |
| 2022/0120154 | A1* | 4/2022 | Maher | E21B 33/064 |

* cited by examiner

SYSTEMS AND METHODS FOR TETHERING SUBSEA BLOW-OUT-PREVENTERS

CROSS-REFERENCE TO RELATED APPLICATIONS

This application claims the benefit of priority to U.S. application Ser. No. 17/432,828 filed on Aug. 20, 2021, which is a national stage entry of International application serial no. PCT/US2020/018874 filed on Feb. 19, 2020, which claims priority to U.S. provisional application Ser. No. 62/808,486 filed on Feb. 21, 2019. U.S. application Ser. No. 17/432,828, International application serial no. PCT/US2020/018874, and U.S. provisional application Ser. No. 62/808,486 are hereby incorporated by reference for all and any purposes.

BACKGROUND

This disclosure relates to systems and methods for tethering subsea Blow-Out-Preventers.

Known tensioning systems for tethering subsea Blow-Out-Preventers ("BOPs") have included high load capacity—on the order of tens of Metric Tons ("MTs"), reels that are used with high stiffness synthetic ropes, or in-line tensioners that are used with pre-cut ropes—either wire ropes or synthetic ropes. Each of these known tensioning systems has strengths and flaws. On the one hand, the reels and locking mechanisms disclosed in U.S. Pat. No. 9,359,852 can allow adjusting the tension in the rope attached between each reel and the subsea BOP with a good resolution. Also, a broad range of rope length can be unwound from each reel, therefore allowing tethering the subsea BOP to anchors located at variable distances from the subsea BOP using a standard set of ropes. However, the tension in the rope tends to relax during use because the rope loops wound on the reel drum can move relative to other rope loops wound on the reel drum. In general, the longer the rope wound on the reel drum is, the easier the tension relaxes. On the other hand, in-line tensioners are structurally simpler than the reels and locking mechanisms disclosed in U.S. Pat. No. 9,359,852. However, in-line tensioners do not usually allow tethering the subsea BOP to anchors located at variable distances from the BOP using a standard set of ropes because the ropes must be pre-cut based on the measured distance between the subsea BOP to the anchors. Also, it is difficult to reuse the ropes so pre-cut on a different subsea BOP.

Thus, there is a continuing need in the art for systems and methods for tethering subsea Blow-Out-Preventers.

BRIEF SUMMARY OF THE DISCLOSURE

The disclosure describes a tensioning system for tethering a subsea BOP. The tensioning system may comprise a frame and a reel rotatably coupled to the frame.

The tensioning system may comprise a tensioning cylinder attached to the frame and a tensioning piston reciprocally disposed in the tensioning cylinder. The tensioning piston may be hollow.

The tensioning system may comprise a gripper assembly movable together with the tensioning piston. The gripper assembly may be hollow. The gripper assembly may include a gripper sleeve. The gripper sleeve may have an expanded position that allows a rope to pass through the gripper assembly without excessive resistance. The gripper sleeve may have a collapsed position that holds the rope. The gripper assembly may include a gripper cylinder movable together with the tensioning piston. The gripper assembly may include a gripper piston reciprocally disposed in the gripper cylinder. The gripper assembly may include a lock sleeve attached to the gripper cylinder. The lock sleeve may be configured to selectively engage an outer diameter of an end of the gripper sleeve. For example, the gripper sleeve may be elastically deformable. Engagement of the lock sleeve with the outer diameter of the end of the gripper sleeve may cause the gripper sleeve to elastically deform toward the collapsed position.

The tensioning system may comprise an insert provided inside the tensioning piston. The insert may include two tapered inner surfaces. The gripper assembly may include a nose that is at least partially contacting one of the two tapered inner surfaces. The other of the two tapered inner surfaces may be curved.

The disclosure also describes a tethering system for tethering a subsea BOP.

The tethering system may include an anchor, a tensioning system as described herein, and a rope. A first end of the rope may be attached to the reel of the tensioning system. A second end of the rope may be attached to one of the subsea BOP and the anchor. The tensioning system may be mounted on the other of the subsea BOP and the anchor.

The tethering system may comprise a capstan rotatably coupled to the frame of the tensioning system. The rope may be wrapped around the capstan. The capstan may have a locked position wherein rotation of the capstan is prevented. The capstan may have an unlocked position wherein the capstan is capable of rotating freely.

The tethering system may comprise a rope deflector. The rope deflector may be positioned such the rope is aligned with the gripper assembly of the tensioning system when the rope is in tension.

The tethering system may comprise a reel lock handle configured to prevent further rotation of the reel and an interface configured to wind or unwind the rope on the reel. The reel lock handle and the interface may be engaged by a Remotely Operated Vehicle ("ROV").

The tethering system may comprise a mechanical lock releasably attached to the frame of the tensioning system, and a mechanical lock handle configured to release the mechanical lock from the frame. The tensioning cylinder of the tensioning system may be held by the mechanical lock.

The disclosure also describes a method of tethering a subsea BOP.

The method may comprise the step of providing a tensioning system and/or a tethering system as described herein. The method may comprise the step of providing a rope. The method may comprise the step of attaching a first end of the rope to the reel of the tensioning system. The method may comprise the step of attaching a second end of the rope to one of the subsea BOP and the anchor. The method may comprise the step mounting the tensioning on the other of the subsea BOP and the anchor.

The method may comprise the step of moving the gripper sleeve of the tensioning system from an expanded position that allows the rope to pass through the gripper assembly without excessive resistance and to a collapsed position that holds the rope. For example, the method may comprise the step of moving a gripper piston disposed inside a gripper cylinder of the tensioning system may be moved. The method may comprise the step of engaging an outer diameter of an end of the gripper sleeve with a lock sleeve attached to the gripper cylinder for causing the gripper sleeve to move from the expanded position to collapsed position. Accordingly, the gripper sleeve may be elastically deformed by engaging the lock sleeve with the outer diameter of the end of the gripper sleeve.

The method may comprise the step of moving a gripper cylinder together with the tensioning piston for adjusting the tension of the rope.

The method may comprise the step of wrapping the rope around the capstan. The method may comprise the step of unlocking the capstan rotatably whereby the capstan is capable of rotating freely relative to the frame. The method may comprise the step of locking the capstan whereby rotation of the capstan is prevented.

The method may comprise the step of aligning the rope with the gripper assembly using a rope deflector integrated into the frame.

The method may comprise the step of releasing a mechanical lock attached to the frame using a mechanical lock handle, wherein the tensioning cylinder is held by the mechanical lock.

BRIEF DESCRIPTION OF THE DRAWINGS

For a more detailed description of the embodiments of the disclosure, reference will now be made to the accompanying drawings, wherein.

DETAILED DESCRIPTION

Figure 1:
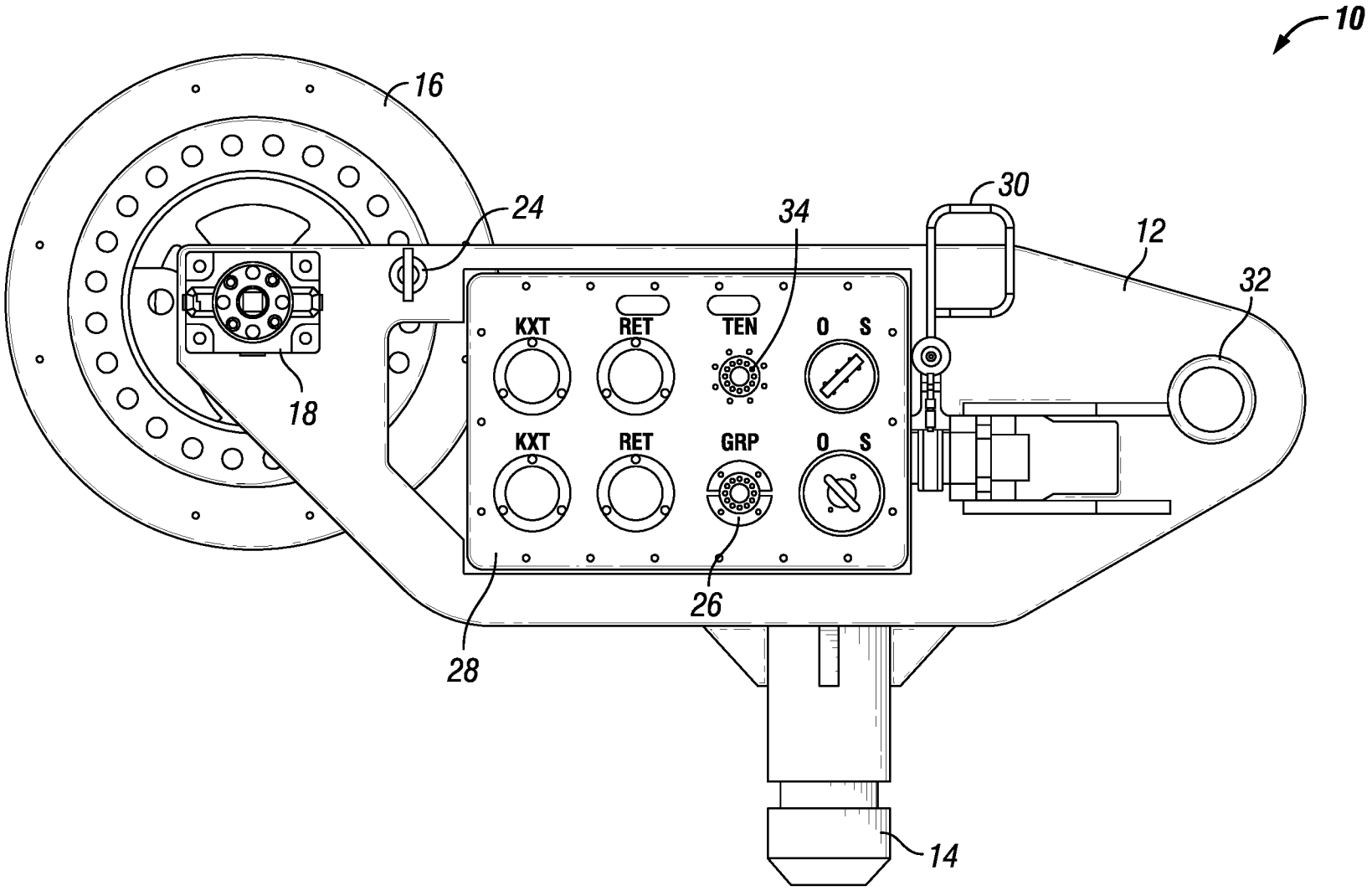
FIG. 1 is an elevation view of a tensioning system in accordance with a first embodiment.
Figure 2:
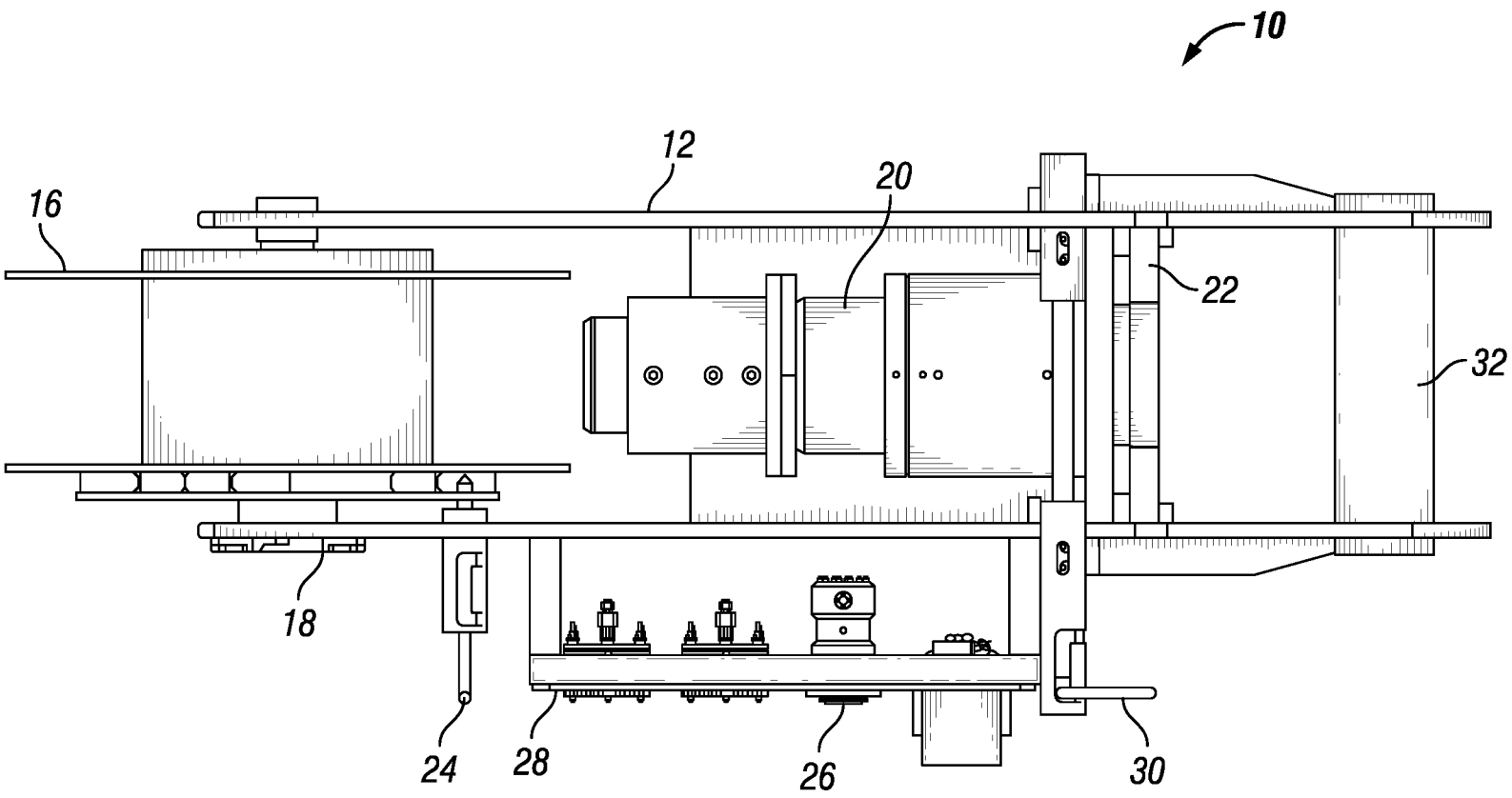
FIG. 2 is a top view of the tensioning system shown in FIG. 1.

FIGS. 1 and 2 show a tensioning system 10, which may be used to tether a subsea BOP to anchors—for example, a suction pile, a Gravity Based Anchor ("GBA"), or a driven pile, secured to the seafloor. The tensioning system 10 includes a frame 12. A pin 14 is secured to the frame 12. In use, the pin 14 may be coupled on either an anchor secured to the seafloor or on the frame of the subsea BOP.

The tensioning system 10 includes a reel 16 rotatably mounted on the frame 12 on which the first end of a rope (not shown) may be attached. The rope may be wound on and/or unwound from the reel 16 by an ROV engaging interface 18 to accommodate for variable distances between the subsea BOP and one of the anchors. As best seen in FIG. 2, the tensioning system 10 includes a combined rope gripper and tension cylinder 20, which is optionally held by a mechanical lock 22 releasably attached to frame 12. The rope passes through the combined rope gripper and tension cylinder 20. Once the length and/or tension of the rope has been adjusted by the ROV, the ROV may actuate a reel lock handle 24 to prevent further rotation of the reel 16. Also, the combined rope gripper and tension cylinder 20 may be actuated to hold the rope and reduce or prevent the release of tension in the rope. The combined rope gripper and tension cylinder 20 is actuated hydraulically by the ROV, preferably via one or more stabbed connections such as stabbed connection 26 provided in the ROV panel 28. The rope gripper engages hydraulically, and the tension cylinder then provides tension/pays in by application of hydraulic pressure.

The combined rope gripper and tension cylinder 20, including the rope held therein, can rapidly be released from the frame 12 by the ROV by actuating the mechanical lock handle 30. Actuating the mechanical lock handle 30 releases the mechanical lock 22 from the frame 12, thereby freeing the combined rope gripper and tension cylinder 20 and the rope held therein.

The frame 12 includes a rope deflector 32 with may be used to ensure that the rope is aligned with the combined rope gripper and tension cylinder 20 when it is in tension.

The ROV panel 28 may include a gauge 34 that indicates the tension in the rope.

Figure 3:
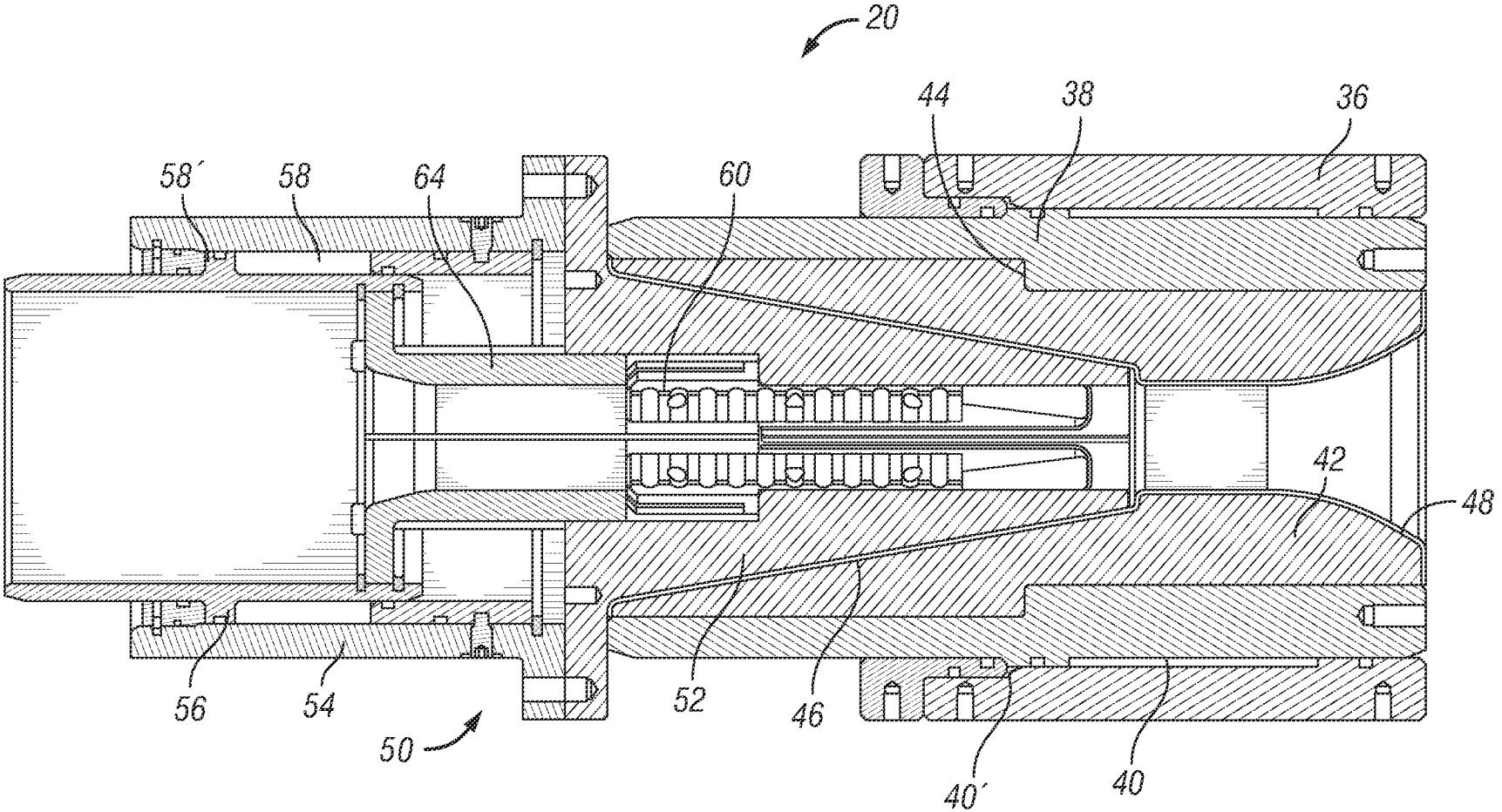
FIG. 3 is a sectional view of a gripper of the tensioning system shown in FIG. 1.

FIG. 3 shows the combined rope gripper and tension cylinder 20. The combined rope gripper and tension cylinder 20 includes a tensioning cylinder 36, which is held by the mechanical lock 22 (shown in FIGS. 1 and 2). A tensioning piston 38 is reciprocally disposed in the tensioning cylinder 36. Hydraulic fluid pumped in chambers 40 and 40' displace the tensioning piston 38 relative to the tensioning cylinder 36 and the frame 12. Thus, when the rope is held in the combined rope gripper and tension cylinder 20, the tension in the rope may be varied. The tensioning piston 38 is hollow. An insert 42 is provided inside the tensioning piston 38 and rests on a shoulder 44 of the tensioning piston. The insert 42 has two tapered inner surfaces 46 and 48. Tapered inner surface 48 is preferably curved and is used to guide the rope. Tapered inner surface 46 may be conical, and is used to receive and retain a gripper assembly 50.

The gripper assembly 50 includes a nose 52 that is sized to engage the tapered inner surface 46. The nose 52 is hollow. A gripper sleeve 60 is provided inside the nose 52. The gripper sleeve 60 has a rough inner surface (e.g., having a plurality of wedges) to grip on the rope. The gripper sleeve 60 is secured inside the nose 52. The gripper sleeve 60 is elastically deformable. For example, the gripper sleeve may have a longitudinal cut providing a C-shaped cross-section. As such, the gripper sleeve 60 has an expanded position that allows the rope to pass through the gripper assembly 50 without excessive resistance and a collapsed position that holds the rope. To function properly, rope properties may be important: high internal friction between the fibers of the rope and a high strength jacketing are preferred. The gripper assembly 50 includes a gripper cylinder 54 that is attached to a base of the nose 52. A gripper piston 56 is reciprocally disposed in the gripper cylinder 54. A lock sleeve 64 is attached to the gripper cylinder 54. The lock sleeve 64 is configured to selectively engage the outer diameter of an end of the gripper sleeve 60 and elastically deform the gripper sleeve 60. Hydraulic fluid pumped in chambers 58 and 58' displace the gripper piston 56 relative to the gripper cylinder 54, the nose 52, and the gripper sleeve 60. Thus, the gripper sleeve 60 may be selectively collapsed, and when the rope passes through the gripper sleeve, the rope may selectively be held.

In use, when rope loops wound on the reel drum move relative to one another, hydraulic fluid may enter in chamber 40 from a pressure source, such as an accumulator or a pump. Hydraulic fluid may also leave chamber 40'. This displacement of the hydraulic fluids can allow the movement of the tensioning piston 38 relative to the tensioning cylinder 36 and the frame 12 in a direction toward the reel 16 (shown in FIG. 1 or 2). Since the gripper assembly 50 is movable together with the tensioning piston 38, the gripper assembly 50 may pull on the rope held in the gripper sleeve 60. Accordingly, the tension in the rope may be controlled by the fluid pressure in the chambers 40 and 40'.

The tensioning system 10 shown in FIGS. 1 and 2 may be suitable for low tension capacity—approximately forty to seventy MTs. The tensioning system 10 may be sufficient to address concerns of BOP fatigue, where the rope stiffness may be more important than tension capacity. Other uses, such as to drive-off BOPs, can require substantially more tension capacity (e.g., in the order of hundreds of MTs).

Figure 4:
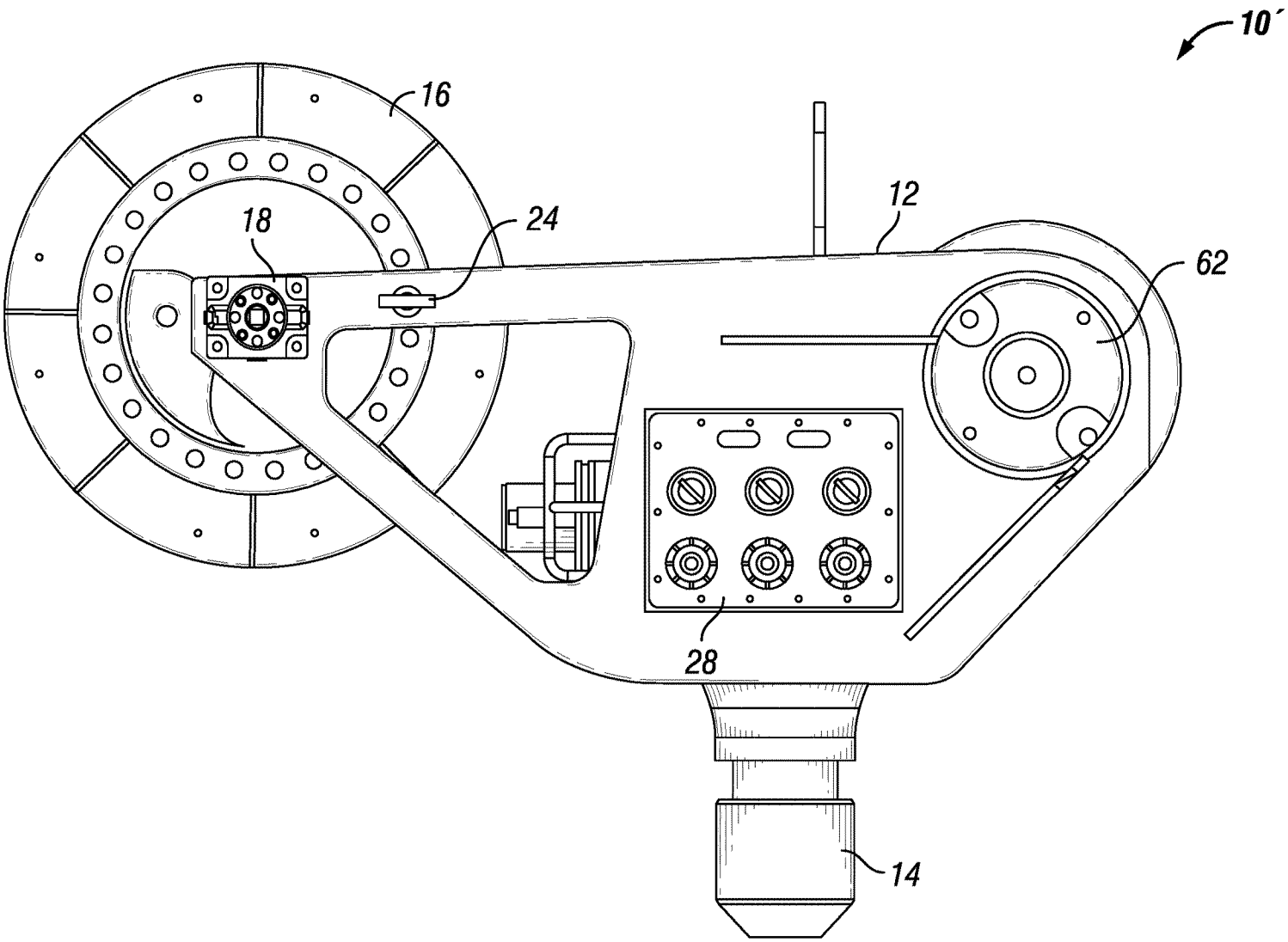
FIG. 4 is an elevation view of a tensioning system in accordance with a second embodiment.
Figure 5:
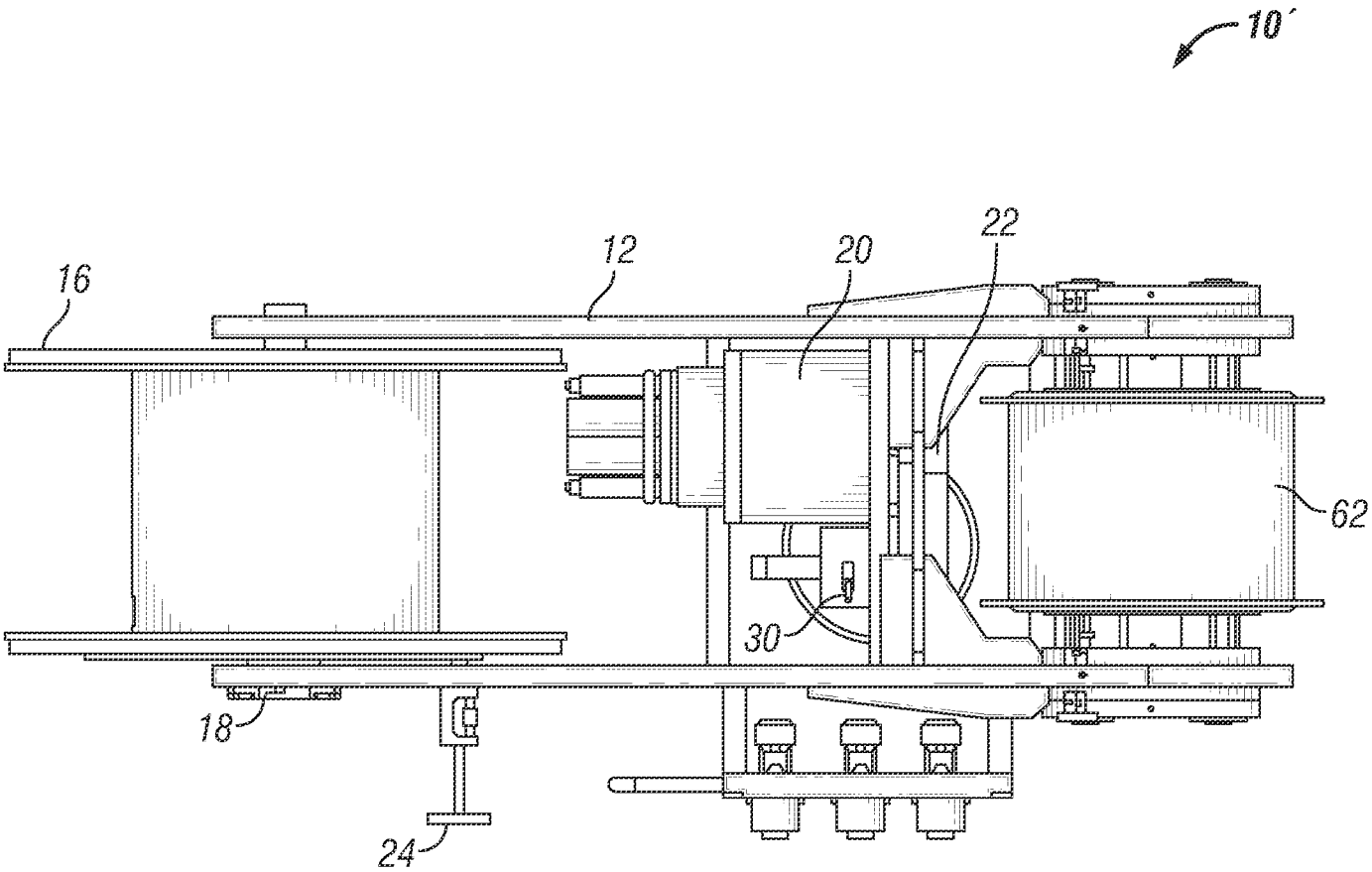
FIG. 5 is a top view of the tensioning system shown in FIG. 4.

The tensioning system 10' illustrated in FIGS. 4 and 5 shares several elements with tensioning system 10 shown in FIGS. 1 and 2, although some elements of the tensioning system 10' may be designed for a tension capacity of four hundred MTs.

One of the differences between the tensioning system 10' illustrated in FIGS. 4 and 5 and the tensioning system 10 shown in FIGS. 1 and 2 is that the rope deflector 32 of the tensioning system 10 is replaced with a capstan 62 in the tensioning system 10'. Compared to the tension capacity of tensioning system 10 shown in FIGS. 1 and 2, the tension capacity of tensioning system 10' can be greatly enhanced by the use of the capstan 62, even if the tension capacity of the combined rope gripper and tension cylinder 20 remains essentially the same. Indeed, when the rotation of the capstan 62 is prevented, a large portion of the tension in the rope can be resisted by the friction between the wraps of the rope and the capstan 62. Only a small portion of the tension in the rope may need to be resisted by the combined rope gripper and tension cylinder 20. For example, the hold tension on the back side of the capstan 62 may be reduced by a factor close to ten compared to the load tension on the front side of the capstan 62 for three to four wraps of wire.

Figure 6:
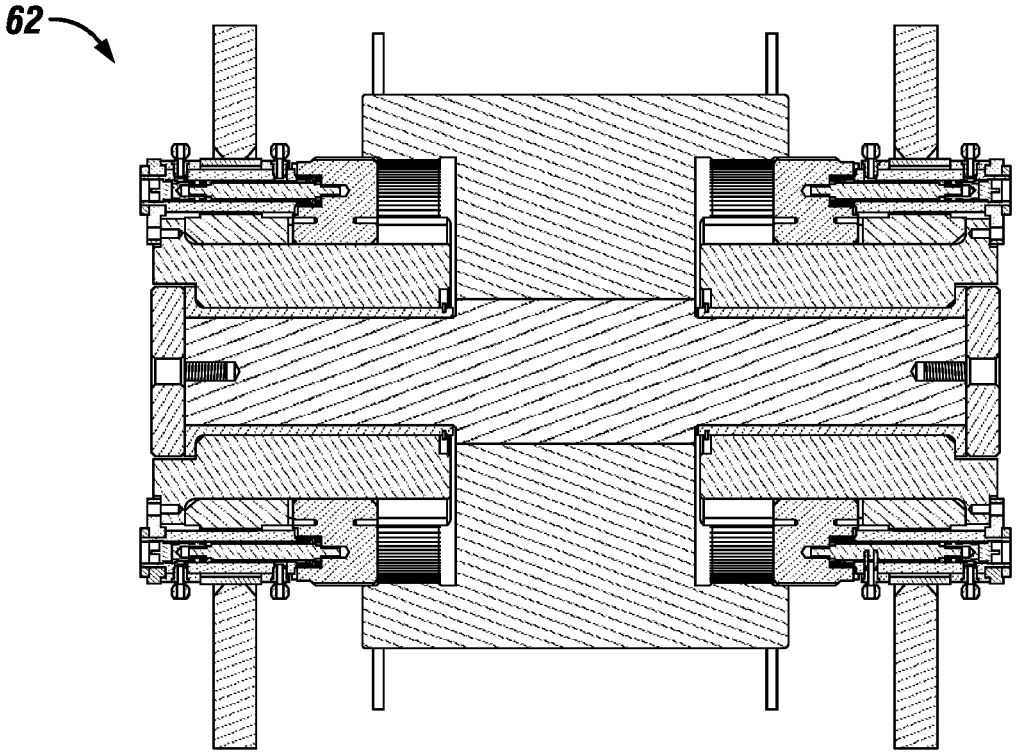
FIG. 6 is a sectional view of the capstan shown in FIG. 5 and illustrated in an unlocked position.
Figure 7:
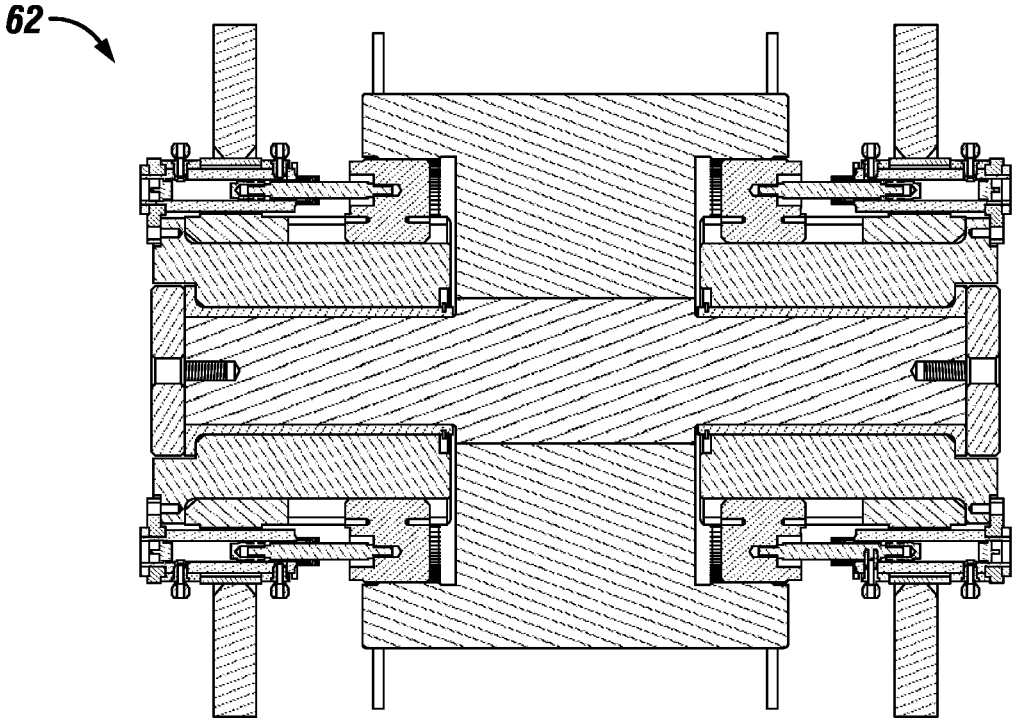
FIG. 7 is the second sectional view of the capstan shown in FIG. 5 and illustrated in a locked position.

The capstan 62 has the capability to free-wheel during the tensioning operations and then hold its orientation once the rope has been properly adjusted for both length and tension. Accordingly, the capstan 62 has a locked position illustrated in FIG. 6 and an unlocked position illustrated in FIG. 7. For example, the locking mechanism of the capstan 62 may be similar to the locking mechanism shown in FIGS. 10-13 of U.S. Pat. No. 9,359,852, which is included herein by reference. The locking mechanism may be selectively actuated via hydraulic pressure provided by the ROV via stabbed connections provided in the ROV panel 28. Thus, another of the differences between the tensioning system 10' illustrated in FIGS. 4 and 5 and the tensioning system 10 shown in FIGS. 1 and 2 is that the ROV panel 28 provides additional ROV control for locking and unlocking of the capstan 62 in the tensioning system 10'.

Figure 8:
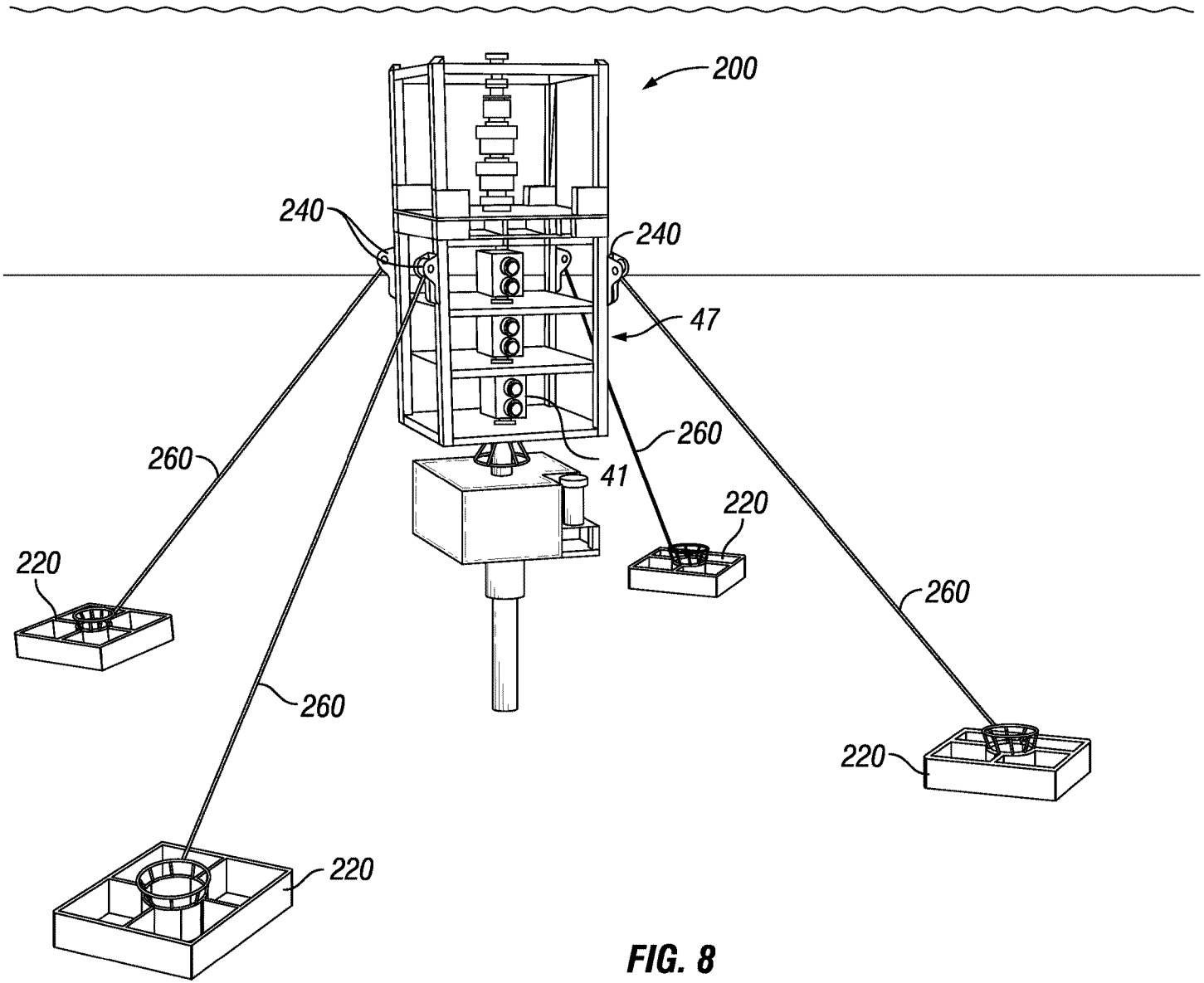
FIG. 8 is a perspective view of a tethering system in accordance with a first embodiment.

Turning to FIG. 8, a tethering system 200 includes a plurality of anchors 220, a plurality of tensioning systems 240, and a plurality of ropes 260. Each of the plurality of ropes 260 is connected to the top of each of the plurality of anchors 220 and extends from each anchor 220 to a tensioning system 240 mounted on frame 47 of BOP 41. In this embodiment, each of the plurality of tensioning systems 240 may be similar to the tensioning system 10 shown in FIGS. 1 and 2, or similar to the tensioning system 10' shown in FIGS. 4 and 5. Tethering system 200 reinforces BOP 41, by resisting lateral loads and bending moments applied thereto. As a result, the tethering system 200 offers the potential to enhance the strength and fatigue resistance of BOP 41. Alternatively, the tethering system 200 may be used to drive-off the BOP 41.

Figure 9:
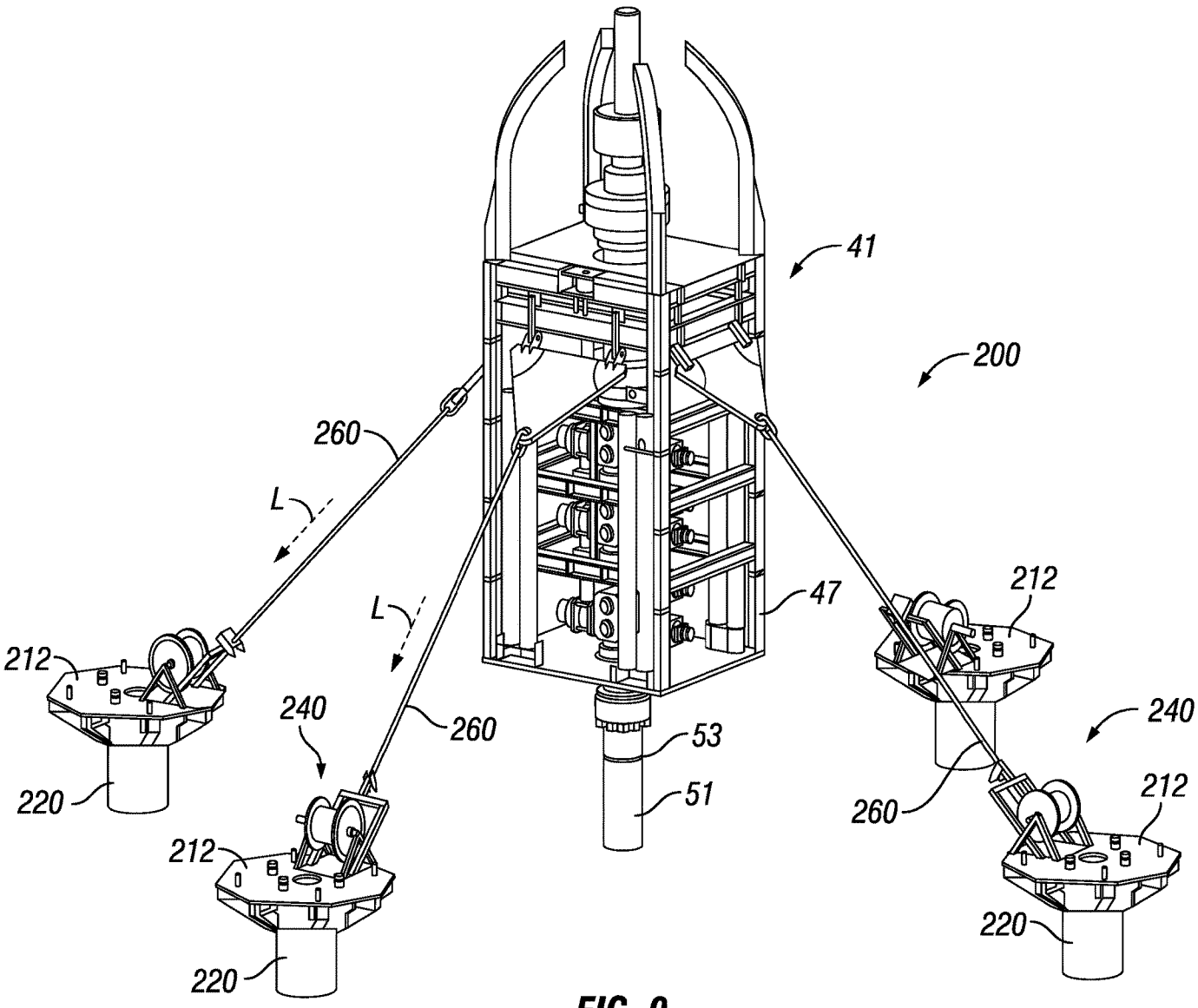
FIG. 9 is a perspective view of a tethering system in accordance with a second embodiment.

Turning to FIG. 9, another embodiment of a tethering system 200 for reinforcing BOP 41, wellhead 53, and primary conductor 51. Tethering system 200 includes a plurality of anchors 220, a plurality of pile top assemblies 212 mounted to anchors 220, a plurality of tensioning systems 240 releasably coupled to pile top assemblies 212, and a plurality of ropes 260. In this embodiment, each of the plurality of tensioning systems 240 may be similar to the tensioning system 10 shown in FIGS. 1 and 2, or similar to the tensioning system 10' shown in FIGS. 4 and 5. Tethering system 200 reinforces BOP 41, wellhead 53, and primary conductor 51 by resisting lateral loads and bending moments applied thereto. As a result, tethering system 200 offers the potential to enhance the strength and fatigue resistance of BOP 41, wellhead 53, and primary conductor 51. Alternatively, the tethering system 200 may be used to drive-off the BOP 41, wellhead 53, or primary conductor 51.

Preferably, as the BOP 41 shown in FIG. 8 or 9 oscillates, the tensioning cylinder 38 does not cyclically retract and extend together with the rope 260, and the rope 260 may remain held in the short term. For example, a locking mechanism, such as a valve or another restriction, that relies on hydraulic pressure by limiting or preventing fluid from entering in and/or leaving chambers 40 and 40', may be provided. Furthermore, the rope 260 preferably remains held in the long term. For example, another locking mechanism, such as the reel lock handle 24, the mechanical lock 22, and/or another mechanical lock, that relies on the mechanical fastening of the rope 260, may be provided. In various embodiments, only one or both of the two locking mechanisms may be provided.

It is to be understood that the disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

What is claimed is:

1. A tethering system for tethering a subsea BOP, comprising:

an anchor; and a tensioning system, the tensioning system including:

a frame;

a reel rotatably coupled to the frame;

a rope, a first end of the rope being attached to the reel;

a capstan rotatably coupled to the frame, the capstan having a locked position wherein rotation of the capstan is prevented, and an unlocked position wherein the capstan is capable of rotating freely;

wherein the rope is wrapped around the capstan.

wherein a second end of the rope is attached to one of the subsea BOP and the anchor;

wherein the tensioning system is mounted on the other of the subsea BOP and the anchor.

2. The tethering system of claim 1, wherein the tensioning system includes an ROV panel having a plurality of stabbed connections, and wherein the capstan is locked by a locking mechanism that is selectively actuated via hydraulic pressure provided via one of the stabbed connections of the ROV panel.

3. The tethering system of claim 1, further comprising:
a reel lock handle configured to prevent further rotation of the reel; and
an interface configured to wind or unwind the rope on the reel;
wherein the reel lock handle and the interface can be engaged by an ROV.

4. The tethering system of claim 1, wherein the tensioning system further comprises:
a tensioning cylinder attached to the frame;
a tensioning piston reciprocally disposed in the tensioning cylinder, the tensioning piston being hollow; and
a gripper assembly movable together with the tensioning piston, the gripper assembly being hollow, the gripper assembly including a gripper sleeve;
wherein the gripper sleeve has an expanded position that allows the rope to pass through the gripper assembly without excessive resistance and a collapsed position that holds the rope.

5. The tethering system of claim 4, further comprising:
a mechanical lock releasably attached to the frame; and
a mechanical lock handle configured to release the mechanical lock from the frame;
wherein the tensioning cylinder is held by the mechanical lock.

6. A method of tethering a subsea BOP, comprising:
providing a tensioning system, the tensioning system including:
a frame;
a reel rotatably coupled to the frame; and
a capstan rotatably coupled to the frame, the capstan having a locked position wherein rotation of the capstan is prevented, and an unlocked position wherein the capstan is capable of rotating freely;
attaching a first end of a rope to the reel of the tensioning system;
attaching a second end of the rope to one of the subsea BOP and the anchor;
mounting the tensioning on the other of the subsea BOP and the anchor;
wrapping the rope around a capstan coupled to the frame;
unlocking the capstan rotatably whereby the capstan is capable of rotating freely relative to the frame; and
locking the capstan whereby rotation of the capstan is prevented.

7. The method of claim 6,
wherein the tensioning system includes an ROV panel having a plurality of stabbed connections, and
wherein locking the capstan includes selectively actuating a locking mechanism via hydraulic pressure provided via one of the stabbed connections of the ROV panel.

8. The method of claim 6,
wherein the tensioning system further includes:
a tensioning cylinder attached to the frame;
a tensioning piston reciprocally disposed in the tensioning cylinder, the tensioning piston being hollow; and
a gripper assembly movable together with the tensioning piston, the gripper assembly being hollow, the gripper assembly including a gripper sleeve; and
wherein the method further includes:
moving the gripper sleeve from an expanded position that allows the rope to pass through the gripper assembly without excessive resistance and to a collapsed position that holds the rope.

9. The method of claim 8, comprising:
moving a gripper piston disposed inside a gripper cylinder;
engaging an outer diameter of an end of the gripper sleeve with a lock sleeve attached to the gripper cylinder for causing the gripper sleeve to move from the expanded position to collapsed position; and
moving a gripper cylinder together with the tensioning piston for varying tension of the rope.

10. The method of claim 8, comprising:
deforming the gripper sleeve elastically by engaging the lock sleeve with the outer diameter of the end of the gripper sleeve.

11. The method of claim 8, comprising:
releasing a mechanical lock attached to the frame using a mechanical lock handle, wherein the tensioning cylinder is held by the mechanical lock.

12. The method of claim 6, comprising:
reducing a hold tension on a back side of the capstan compared to a load tension on a front side of the capstan.

* * * * *